US005613475A

United States Patent [19]

Firey

[11] Patent Number: 5,613,475

[45] Date of Patent: Mar. 25, 1997

[54] GASOLINE FUEL INJECTOR COMPENSATOR

[76] Inventor: Joseph C. Firey, P.O. Box 15514, Seattle, Wash. 98115-0514

[21] Appl. No.: 612,485

[22] Filed: Mar. 7, 1996

[51] Int. Cl.[6] ..... F02M 37/04

[52] U.S. Cl. ..... 123/496; 123/509

[58] Field of Search ..... 123/509, 496, 123/500, 501, 502, 497, 446; 417/380

[56] References Cited

U.S. PATENT DOCUMENTS

| | | | |
|---|---|---|---|
| 3,913,548 | 10/1975 | Wilson | 123/496 |
| 4,098,560 | 7/1978 | O'Neill | 417/380 |
| 4,141,675 | 2/1979 | O'Neill | 417/380 |
| 4,599,983 | 7/1986 | Omachi | 417/380 |
| 4,714,066 | 12/1987 | Jordan | 123/496 |
| 4,807,573 | 2/1989 | Schierling | 123/496 |
| 4,928,656 | 5/1990 | Ausiello | 123/497 |
| 5,067,467 | 11/1991 | Hill | 123/497 |
| 5,456,232 | 10/1995 | Firey | 123/430 |
| 5,483,937 | 1/1996 | Firey | 123/435 |

*Primary Examiner*—Carl S. Miller

[57] ABSTRACT

A compensator scheme is described to compensate variable pressure gasoline injection systems, used on four stroke cycle gasoline engines, for variations of engine speed and intake manifold pressure. The intake manifold pressure compensator adjusts the compression ratio of the gas pressure cycling means of the variable pressure injection system. The engine speed compensator adjusts the ratio of liquid injection pressure to gas pressure in the gas pressure cycling means. Both compensators can be corrected by use of feedback from an engine exhaust gas composition sensor.

9 Claims, 8 Drawing Sheets

GASOLINE FUEL INJECTOR COMPENSATOR

CROSS REFERENCES TO RELATED APPLICATIONS

The invention described herein is particularly suitable for use with the gasoline fuel injector systems described in my U.S. Pat. No. 5,456,232 entitled, "Gasoline Fuel Injector System." The invention described herein can be used to replace my invention described in U.S. Pat. No. 5,483,937 entitled, "Actuator for Gasoline Fuel Injector System."

BACKGROUND OF THE INVENTION

1. Field of the invention

This invention is in the field of fuel injection systems for internal combustion engines, and particularly fuel injection systems for four stroke cycle engines which inject the fuel into the engine intake manifold.

2. Description of the Prior Art

Within the past several years the gasoline engine carburetor has been largely replaced with intake manifold gasoline injector systems in many engine applications. Most of these prior art gasoline injector systems inject the fuel at constant pressure and control the fuel quantity by controlling the time duration of injection. An electronic controller, responsive to engine intake air flow rate and engine speed sensors, adjusts time duration of fuel injection so as to maintain the desired overall air to fuel ratio created in the intake manifold. The electronic controller can be additionally responsive to engine exhaust gas composition sensors which provide a feedback control to more closely adjust fuel injection duration, and hence overall air to fuel ratio, for minimum emission of undesirable exhaust gas constituents. This capability of using a feedback control from the exhaust is a principal reason why carburetor fuel systems were replaced with fuel injector systems, since it is difficult to properly introduce feedback control into a carburetor system.

A particular benefit of typical carburetor fuel systems is that the instantaneous rate of fuel flow is roughly proportional to the instantaneous rate of air flow. As a result, during each engine intake stroke, regions of excessively lean air to fuel ratio and other regions of excessively rich air to fuel ratio can be largely avoided and a roughly uniform instantaneous air to fuel ratio is created in each intake mixture charge going into each engine cylinder.

Present gasoline injector systems tend to create both excessively rich air fuel mixture regions and excessively lean air fuel mixture regions since the instantaneous rate of fuel flow is not proportioned to the instantaneous rate of air flow into the engine intake manifold. While fuel injection is taking place an over rich region is created, and, after injection ceases an over lean region is created during each engine intake stroke. The over rich region and the over lean region survive compression, in large part, and their subsequent combustion creates undesirable emission components characteristic of both over lean operation and over rich operation even though the overall air fuel ratio is neither over rich nor over lean.

A principal undesirable exhaust emission from over lean mixtures is oxides of nitrogen, whereas from over rich mixtures carbon monoxide and unburned hydrocarbons are among the undesirable exhaust emissions. Between these over lean mixtures and over rich mixtures a rather narrow "window" of mixture ratios exists where net emissions of both types of undesirable exhaust constituents can be minimized. Yet, even when the overall mixture ratio of an engine lies within this narrow "window," excess emissions may occur if this overall mixture is non uniform and stratified, as when present gasoline injector systems are used which create both over lean regions and over rich regions within each air fuel mixture charge going into each engine cylinder.

It would be very beneficial to have available a gasoline fuel injection system, capable of proportioning instantaneous fuel flow rate to instantaneous air flow rate so that a uniform mixture ratio existed, and lying within the minimum net emissions window, for each air fuel mixture charge going into each engine cylinder. Yet further reductions of undesirable exhaust emissions could be achieved in this way.

3. Definitions of Internal Combustion Engines

The devices of this invention are intended to be used with a four stroke cycle internal combustion engine mechanism, comprising various elements as are well known in the prior art of internal combustion engines, of which the following elements connect to or cooperate with the devices of this invention:

A. Pistons operate within cylinders, and are driven from a rotating crankshaft, via a connecting rod, to vary the volume of a variable volume chamber enclosed between the cylinder walls and the piston crown.

B. Intake valves, at least one for each cylinder, connect and disconnect the variable volume chamber to and from an intake air supply manifold.

C. Exhaust valves, at least one for each cylinder, connect and disconnect the variable volume chamber to and from an exhaust gas manifold.

D. These intake and exhaust valves are opened and closed by a valve drive means driven in turn from the engine crankshaft so that each engine cylinder carries out a four stroke cycle which is repeated. This four stroke cycle comprises, in time order: an air intake stroke whenever the piston is moving to increase the volume of the variable volume chamber and the intake valve is open and the exhaust valve is closed; a compression stroke whenever the piston is moving to decrease the volume of the variable volume chamber and both intake and exhaust valves are closed;. an expansion stroke whenever the piston is moving to increase the volume of the variable volume chamber and both intake and exhaust valves are closed; an exhaust stroke whenever the piston is moving to decrease the volume of the variable volume chamber and the exhaust valve is open and the intake valve is closed.

E. A fuel supply source supplies fuel to the engine and this fuel is mixed into the intake air in the intake manifold.

F. An ignition means ignites the air fuel mixture at some time during the latter part of the compression stroke or the early part of the expansion stroke, and a combustion process thus intervenes between compression and expansion processes. Electric spark ignition means are commonly used but compression alone can be used to cause compression ignition of the air fuel mixture.

G. In many engine applications a torque control means is used for controlling the torque output via the engine crankshaft averaged during at least one or more of the four stroke cycles. For gasoline fueled internal combustion engines the torque controller is often a throttle valve in the air intake manifold which, by controlling the air density during the intake stroke, controls the mass air flow rate per intake stroke, and thus the air mass quantity available for combustion and thus controls the torque output. An intake air supercharger can be used additionally or alternatively as a means for controlling the air density during the intake stroke. For diesel fueled internal combustion engines, using compression ignition, the torque controller usually functions to control the fuel mass flow rate per intake stroke, and thus the fuel quantity available for combustion.

H. During each intake stroke the instantaneous air mass flow rate varies greatly, being related to the velocity of motion of the piston during intake. Since piston velocity changes from zero at the start and end of the intake stroke to maximum during the middle portion of the intake stroke, instantaneous air mass flow rate correspondingly varies from zero or low at the start and end of the intake stroke to maximum during the middle portion of the intake stroke.

I. The instantaneous fuel mass flow rate is not necessarily related to the piston velocity or the instantaneous air mass flow rate but depends upon the fuel introduction device used. When a carburetor is used to introduce fuel into the air intake manifold it is the instantaneous air flow rate through the carburetor venturi which generates the pressure difference forcing fuel into the intake manifold. As a result a rough correspondence exists between instantaneous air flow rate and instantaneous fuel flow rate when a carburetor is used. When a timed fuel injector is used, at constant fuel nozzle pressure difference, the instantaneous fuel flow rate is essentially constant during injection, the total fuel quantity injected per intake stroke being proportioned to the total air quantity per intake stroke by controlling the duration of fuel injection.

J. The mean value of air fuel ratio during any one engine intake stroke is the mass ratio of the air flow rate per intake stroke to the fuel flow rate per intake stroke. If electric spark ignition is used to initiate the combustion process this mean value of air fuel ratio must be kept within the spark ignition range. Where compression ignition is used to initiate the combustion process this mean value of air fuel ratio can be varied over a wider range than the spark ignition range.

4. General Description of Gasoline Fuel Injection System

The gasoline engine fuel injection systems of my invention described in U.S. Pat. No. 5,456,232, are improvements for use in combination with a four stroke cycle internal combustion engine mechanism as described hereinabove. All forms of this fuel injection system comprise the following elements, and each piston and cylinder of the internal combustion engine mechanism is served by one such fuel injection system:

1. A gas pressure cycling means is used for cycling the pressure of a gas quantity within a separate variable volume chamber enclosed between a container and a sealable moving element. The gas pressure cycling means also comprises a pressure cycler means for driving the moving element to alternately decrease the variable volume and thus increase the pressure of the gas quantity and then increase the variable volume and thus decrease the pressure of the gas quantity.

The variable volume chamber of the gas pressure cycling means is preferably connected to the engine air supply manifold during the ending of a pressure decrease and the start of the next pressure increase so that the starting pressure of each cycle of pressure increase and decrease equals the engine intake manifold pressure.

2. An inter drive means for driving the pressure cycler drive means from the engine crankshaft is timed so that a single cycle of pressure increase followed by pressure decrease occurs during each engine intake stroke, and the duration of each cycle of pressure increase and decrease is essentially equal to the duration of the intake stroke.

3. A fuel injector means is used for injecting liquid fuel into the engine air supply manifold during each intake stroke. The fuel injector comprises: a nozzle connecting into the engine air supply manifold; a liquid fuel chamber with a liquid pressurizer means, such as a sealed piston or bellows; a nozzle valve and drive means for connecting and disconnecting the nozzle to the liquid fuel chamber; a fuel supply valve and drive means for connecting and disconnecting the liquid fuel chamber to a source of supply of liquid fuel at pressure at least greater than atmospheric pressure.

4. An intake stroke sensor is used to sense both the start and the end of each intake stroke. This sensor output is input to a fuel valve controller which controls the opening and closing of both the nozzle valve and the fuel supply valve of the fuel injector means so that, the nozzle is connected to the liquid fuel chamber only during and throughout each intake stroke, and the fuel supply source is connected to the liquid fuel chamber only when the nozzle is disconnected from the liquid fuel chamber.

5. A pressure transmitter is used to transmit pressure from the variable volume chamber of the gas pressure cycler to the liquid fuel within the liquid fuel chamber of the fuel injector only during and throughout each intake stroke. This pressure transmitter can be for example a simple sealed piston connected directly to the liquid pressurizer of the fuel injector and acted upon by the gas pressure in the variable volume chamber of the gas pressure cycler during each intake stroke. To avoid pressure transmission to the liquid fuel chamber during all engine strokes other than the intake stroke, various means can be used, such as a valve to vent the variable volume chamber of the gas pressure cycler only during these other strokes.

With the above minimum number of elements, and these connected as described, this example fuel injection system operates as follows:

1. During and throughout each engine intake stroke pressure is created in the variable volume chamber of the gas pressure cycler whose moving element is being driven by the pressure cycler drive means and the inter driver means from the engine crankshaft.

2. This pressure created in the variable volume chamber of the gas pressure cycler acts via the pressure transmitter to create a pressure on the liquid fuel in the liquid fuel chamber of the fuel injector during and throughout each engine intake stroke.

3. The fuel injector nozzle valve being opened during and throughout each intake stroke by action of the fuel valve controller, liquid fuel is injected into the intake manifold via the fuel injector nozzle under the effect of the pressure created in the liquid fuel chamber. Such injection of liquid fuel into the engine intake manifold occurs only during and throughout the intake stroke since the nozzle valve is closed during all other engine strokes.

4. While the fuel injector nozzle valve of the fuel injector is closed during all engine strokes other than the intake stroke the fuel supply valve is opened by action of the fuel valve controller so that liquid fuel from the supply source can be forced by supply pressure into the liquid fuel chamber of the fuel injector to replace that fuel injected into the engine intake manifold during the preceding intake stroke. No pressure is transmitted to the liquid fuel chamber during all engine strokes other than the intake stroke so that such refueling of the liquid fuel chamber can occur and so that the liquid pressurizer means of the fuel injector and the pressure transmitter can be returned to starting positions.

5. The fuel supply valve of the fuel injector is closed by action of the fuel valve controller so that fuel does not backflow into the supply source during the intake stroke when the liquid fuel chamber is under the pressure created by the gas pressure cycler acting via the pressure transmitter.

In this way the liquid fuel is injected into the engine intake manifold during and throughout each intake stroke at the same time that intake air is also flowing into the engine cylinder during and throughout the intake stroke. During each intake stroke the instantaneous mass rate of flow of air through the intake manifold and into the engine cylinder is approximately proportional to the instantaneous piston speed, which varies roughly sinusoidally from zero at piston top and bottom dead centers to a maximum near piston mid travel. Also during each intake stroke the instantaneous mass rate of flow of liquid fuel through the fuel injector nozzle and into the intake manifold and thence, in company with the intake air flow, into the engine cylinder is approximately proportional to the square root of the net pressure difference between the liquid fuel chamber and the intake manifold. This net pressure difference is created by action of the gas pressure cycler and the pressure transmitter, and varies during the intake stroke. The instantaneous mass ratio of air to fuel of the air fuel mixtures thusly created in the engine intake manifold can be varied during the intake stroke by varying the pressure transmitted into the liquid fuel chamber from the gas pressure cycler. Hence many different regions of air fuel mixture can be created within each total charge of air and fuel going into the engine cylinder during each intake stroke by suitable variation of the pressure in the liquid fuel chamber relative to the instantaneous mass rate of flow of air.

In many engine uses it will be preferred that all regions of air fuel mixture be nearly alike in air fuel ratio in order to avoid both over rich regions and over lean regions and thus to avoid the undesirable exhaust emissions generated during the combustion of such regions. A constant mixture ratio cam drive means for driving the moving element of the gas pressure cycler is described in U.S. Pat. No. 5,456,232, and is one example scheme for achieving uniformity of air fuel ratio in all mixture regions of each total charge of air and fuel going into the engine cylinder during each intake stroke. This constant mixture ratio cam drive means is one of the preferred drive means for driving the moving element of the gas pressure cycler because of this beneficial minimizing of engine exhaust emissions thus made possible.

In other engine uses it may be preferred that a stratified mixture be created in the engine intake wherein different regions possess different air fuel ratios. Such stratified intake air fuel mixture can be used to suppress the violence of compression ignition combustion by methods described in U.S. Pat. No. 4,147,137 AND U.S. Pat. No. 4,425,892 and this material is incorporated herein by reference thereto. The devices of U.S. Pat. No. 5,456,232 can be used to create such stratified intake air fuel mixtures in several ways. For example, such a stratified intake mixture can be generated by driving the moving element of the gas pressure cycler relative to the engine crankshaft so that the ratio of the instantaneous fuel mass flow rate into the intake manifold to the instantaneous air mass flow rate into the intake manifold varies about a mean value during each intake stroke. If the moving element of the gas pressure cycler is a piston operative within a cylinder, and this piston is driven by a conventional crank and connecting rod drive means from a shaft whose speed is twice the engine crankshaft speed, a stratified mixture will be generated principally because the instantaneous mass rate of fuel flow varies non linearly with the pressure in the liquid fuel chamber. This crank and connecting rod drive for the moving element of the gas pressure cycler is one example of a stratifier means. Other stratifier means are described in U.S. Pat. No. 5,456,232.

5. Compensation for Engine Speed and Torque Changes: The simple form of gasoline fuel injector system described hereinabove is suitable for use on internal combustion engines operated at steady torque and speed, as for example in some kinds of water pumping or electric power generating use. But many internal combustion engines are operated at widely varying torque and speed, as for example in automobiles and trucks. Engine torque output is commonly varied by varying the density of the air entering the engine air intake manifold, as by use of a throttle, and by use of an intake air supercharger, in order to vary the mass rate of air flow per intake stroke. But the mass rate of liquid fuel flow per intake stroke may not be correspondingly varied when intake air density is thusly varied. Thus the mean value of air fuel ratio for each intake stroke, which is the ratio of mass rate of air flow per intake stroke to mass rate of flow of fuel per intake stroke, will become fuel leaner as intake air density is increased and will become fuel richer as intake air density is decreased with the simple form of gasoline fuel injector described hereinabove.

At a particular intake air density the mass rate of air flow per intake stroke will remain roughly constant over a rather wide range of engine speeds. But the mass rate of flow of liquid fuel per intake stroke decreases as engine speed increases, for the simple form of gasoline fuel injector described hereinabove, since the time rate of instantaneous liquid fuel flow is essentially constant and the time duration of the intake stroke and hence the time duration for liquid fuel flow decreases as speed increases. Thus the mean value of air fuel ratio for each intake stroke will become leaner as engine speed increases and will become richer as engine speed decreases with this simple form of gasoline fuel injector described hereinabove.

Modified pressure transmitter means or modified fuel injector means can be used to achieve essentially constant values of mean air fuel ratio per intake stroke with widely varying engine torque and speed as described in application Ser. No. 08/323,021.

6. Detailed descriptions of Gasoline Fuel Injector Systems suitable for use with the devices of this invention are presented in my U.S. Pat. No. 5,456,232 and this material is incorporated herein by reference thereto.

7. Methods of compensation of these gasoline engine fuel injectors for variations of engine speed and torque are described in my U.S. Pat. No. 5,483,937, but these methods are mechanically rather complex. It would be desirable to have available simpler compensator devices.

SUMMARY OF THE INVENTION

The gasoline fuel injector compensators of this invention are used to compensate gasoline fuel injection systems as described in my U.S. Pat. No. 5,456,232. These fuel injection systems are for use on four stroke cycle gasoline engines and comprise:

(a) A gas pressure cycler, which generates a cycle of gas pressure increase and decrease coincident with each engine intake stroke;

(b) A liquid fuel injector, which injects gasoline into the engine intake manifold during each engine intake stroke;

(c) A pressure transmitter, which transmits the variable pressure, generated in the gas pressure cycler, to the liquid fuel in the fuel injector, so that fuel injection pressure varies in a cycle of fuel pressure increase and decrease coincident with each engine intake stroke;

(d) In some forms of this fuel injection system the pressure transmitter is adjustable so that the ratio of liquid fuel injection pressure to gas pressure in the gas pressure cycler can be adjusted;

The various details of these gasoline fuel injection systems are described in my U.S. Pat. No. 5,456,232, and this material is incorporated herein by reference thereto.

As engine speed increases, the time available for fuel injection, into the air mass entering the engine cylinder during each intake stroke, decreases. Thus the rate of fuel injection must be increased at higher engine RPM if an essentially constant fuel to air ratio is to be maintained.

As engine intake manifold pressure increases, the air mass entering the engine cylinder during each intake stroke, increases. Here also the rate of fuel injection must be increased at higher intake manifold pressure if an essentially constant fuel to air ratio is to be maintained.

The invention described herein comprises two compensators:

(e) An engine RPM compensator, which adjusts the pressure transmitter to increase the ratio of liquid fuel injection pressure to gas cycler pressure, as engine RPM increases;

(f) An engine intake manifold pressure compensator, which adjusts the compression ratio of the gas pressure cycler to increase the compression ratio, and hence to increase the gas cycler pressure and thus the liquid fuel injection pressure, as engine intake manifold pressure increases;

(g) An essentially constant fuel to air ratio can, in this way, be maintained, within the air fuel mixture entering the engine cylinder during each intake stroke, over a wide range of engine speeds and intake pressures. This is one of the principal beneficial objects of this invention;

(h) The engine exhaust gas composition can be sensed, and then act via a feedback to correct, either the engine RPM compensator, or the engine intake manifold pressure compensator, or both, to maintain fuel to air ratios within very narrow limits;

A mechanical form of engine KPM compensator uses a positive displacement pump, driven at a fixed multiple of engine RPM, to pump a liquid through a flow restrictor. The pressure thusly generated, upstream of the flow restrictor, acts via a hydraulic cylinder actuator, and suitable linkage, to adjust the pivot position of the pivoted lever pressure transmitter of the gasoline fuel injector system. As engine speed increases the pivot is moved to increase the leverage of the pressure in the gas pressure cycler, and hence to increase the pressure of the liquid fuel in the liquid fuel injector, as desired to maintain a constant fuel to air ratio.

A mechanical form of engine intake manifold pressure compensator uses a piston and spring pressure comparator to compare engine intake pressure with a constant reference pressure, such as atmospheric pressure. As intake manifold pressure decreases this pressure comparator acts to open one or more added volumes connecting into the gas pressure cycler. As more volumes are added, the gas pressure generated by the gas pressure cycler, and thus the pressure of the liquid fuel in the liquid fuel injector, decreases in-order to maintain the desired constant fuel to air ratio.

An electronic form of exhaust gas composition feedback corrector uses an electronic exhaust gas composition sensor to sense the gas concentration of one or more gas components, such as oxygen gas and carbon monoxide gas. The feedback corrector can correct the operating fuel to air ratio in one or a combination of the following ways for mechanical compensators:

(i) The volume of one or more added volumes can be changed;

(j) Flow restrictors between one or more added volumes can be adjusted;

(k) The flow restrictor of the engine RPM compensator can be adjusted;

BRIEF DESCRIPTION OF THE DRAWINGS

An example gasoline fuel injector compensator is shown schematically in FIG. 1 in combination with a four stroke cycle engine equipped with a gasoline fuel injector system.

Details of the example fuel injector system and compensator of FIG. 1 are shown in FIG. 2.

Figure 3:
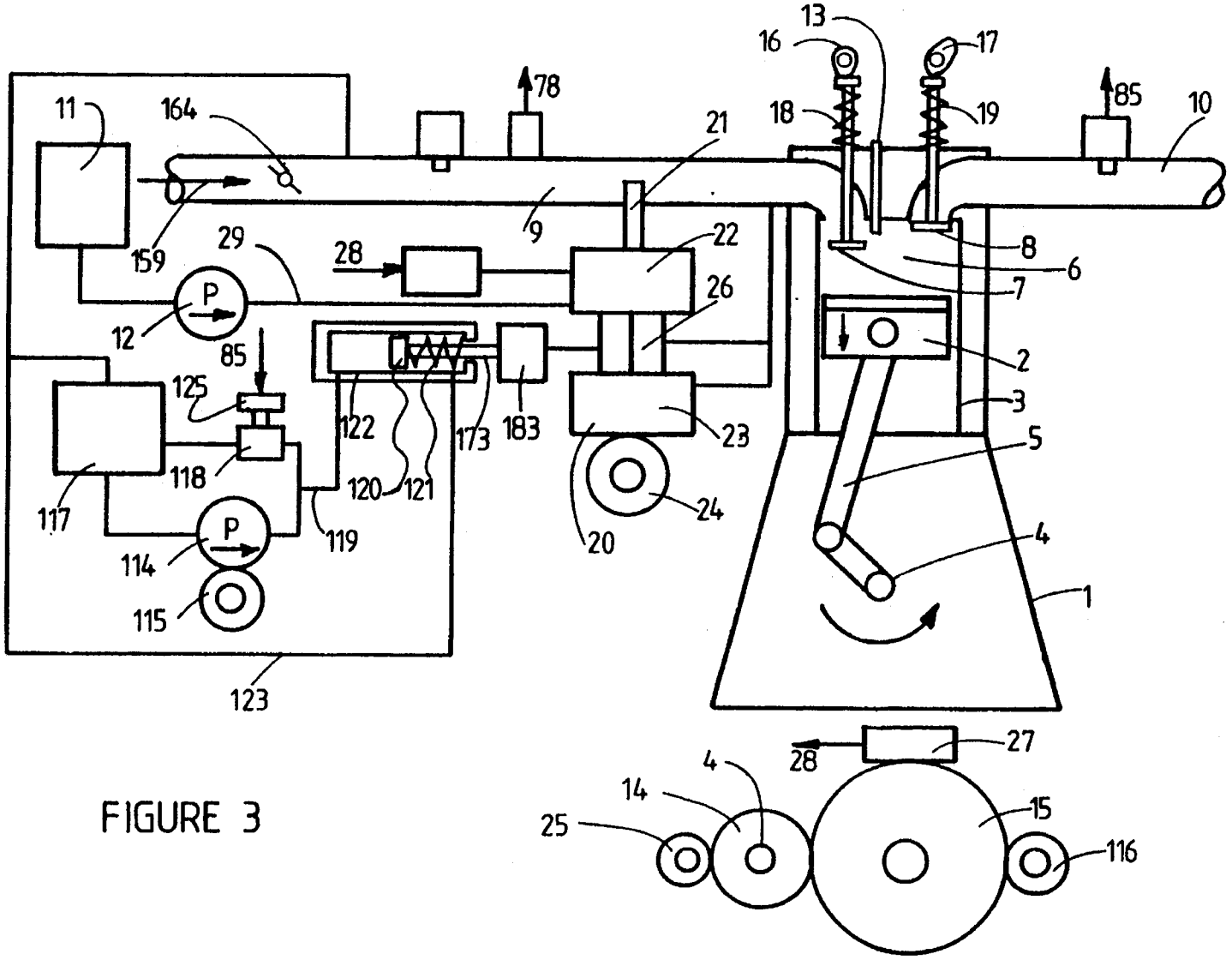
Figure 4:
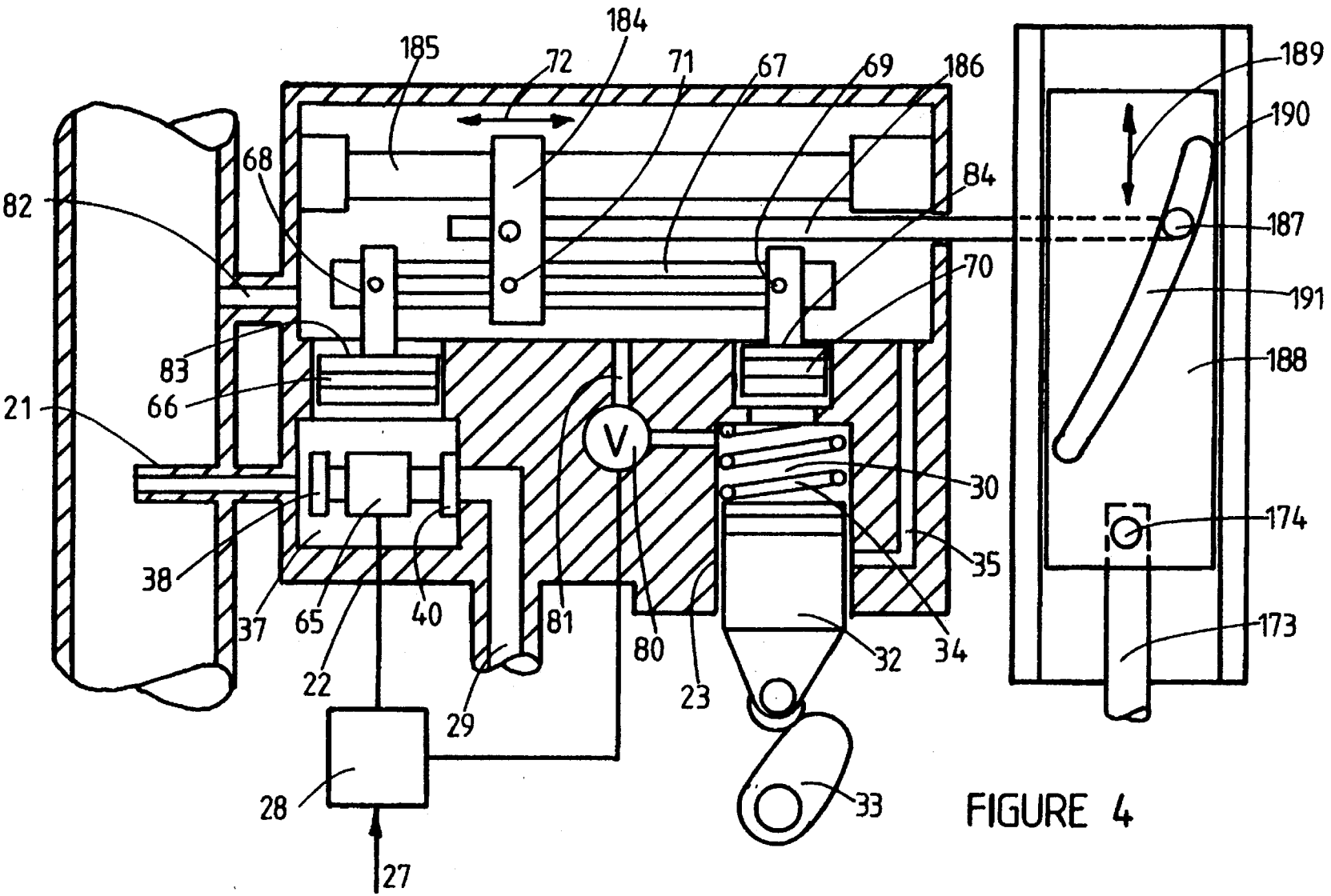
Figure 5:
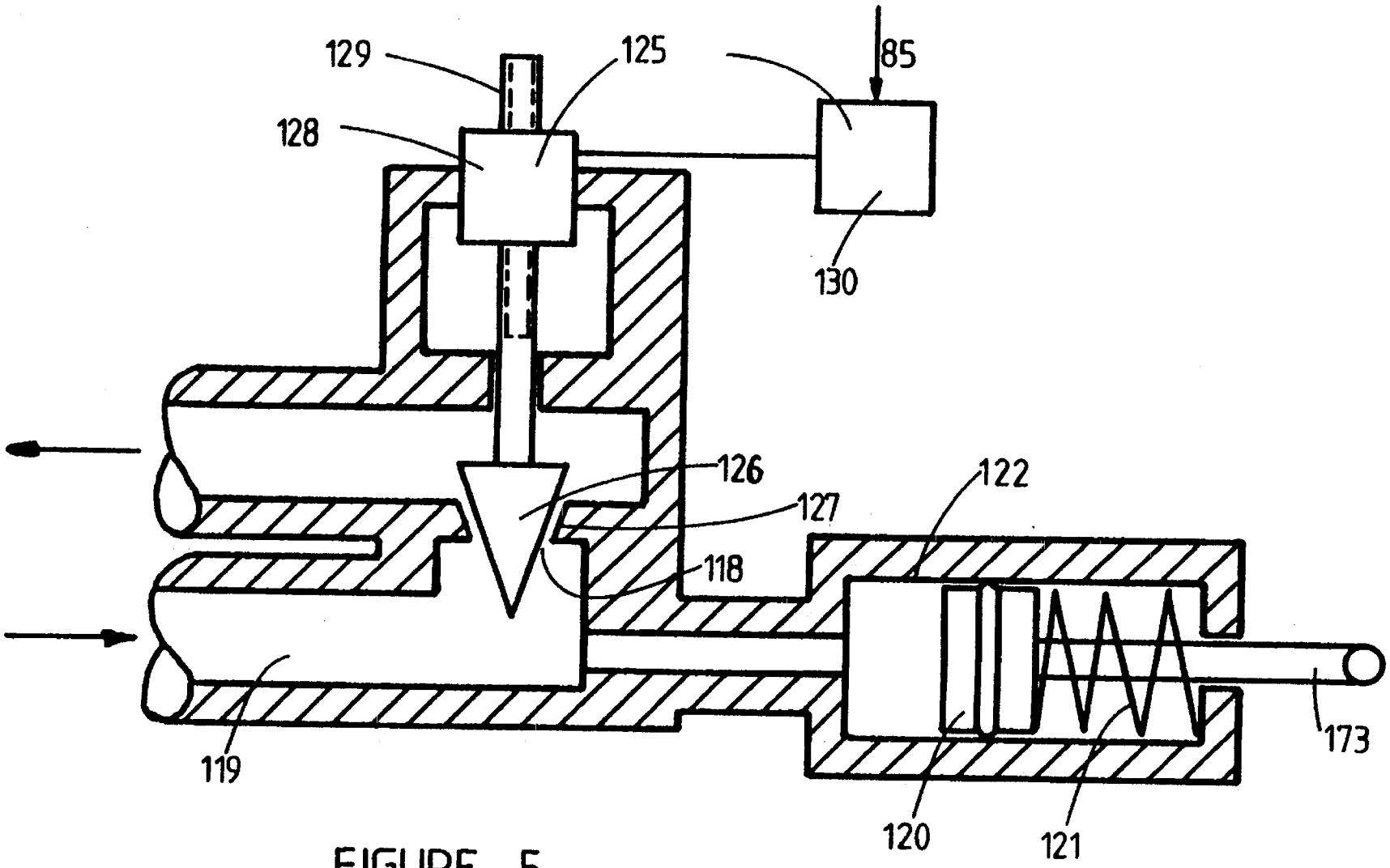

Another type of gasoline fuel injector compensator is shown schematically in FIG. 3 with additional details shown in FIG. 4 and FIG. 5.

Figure 1:
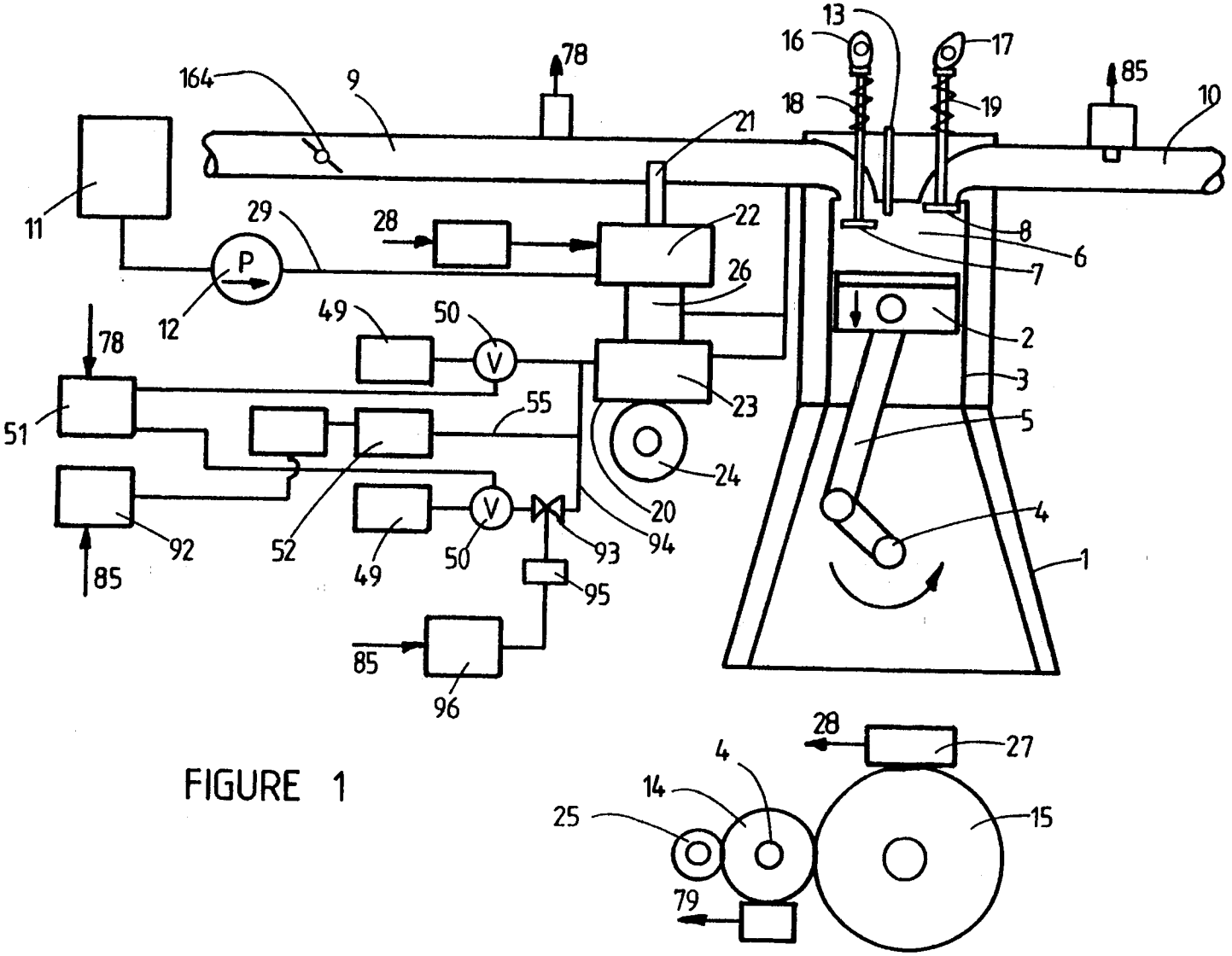
Figure 2:
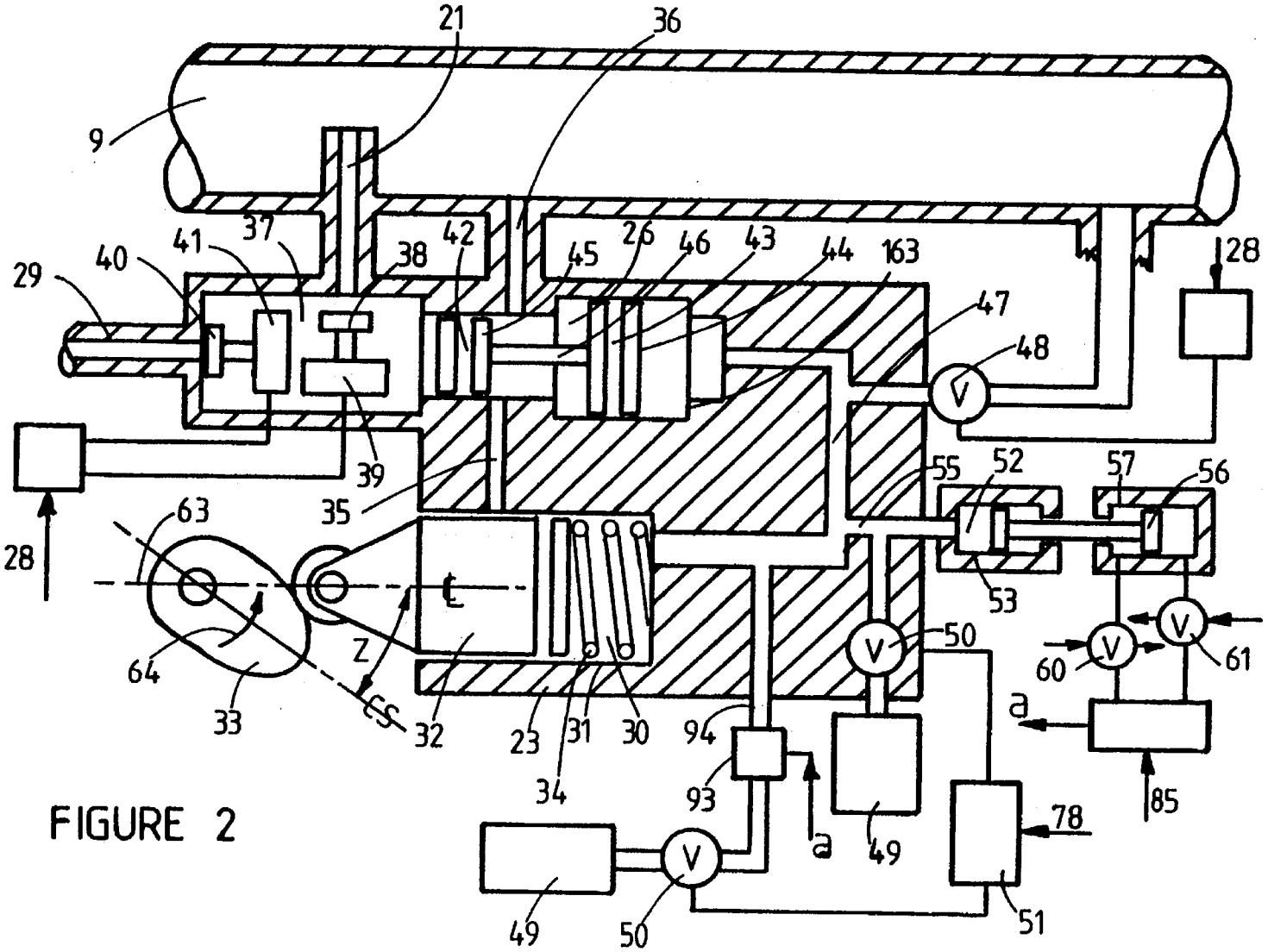
Figure 6:
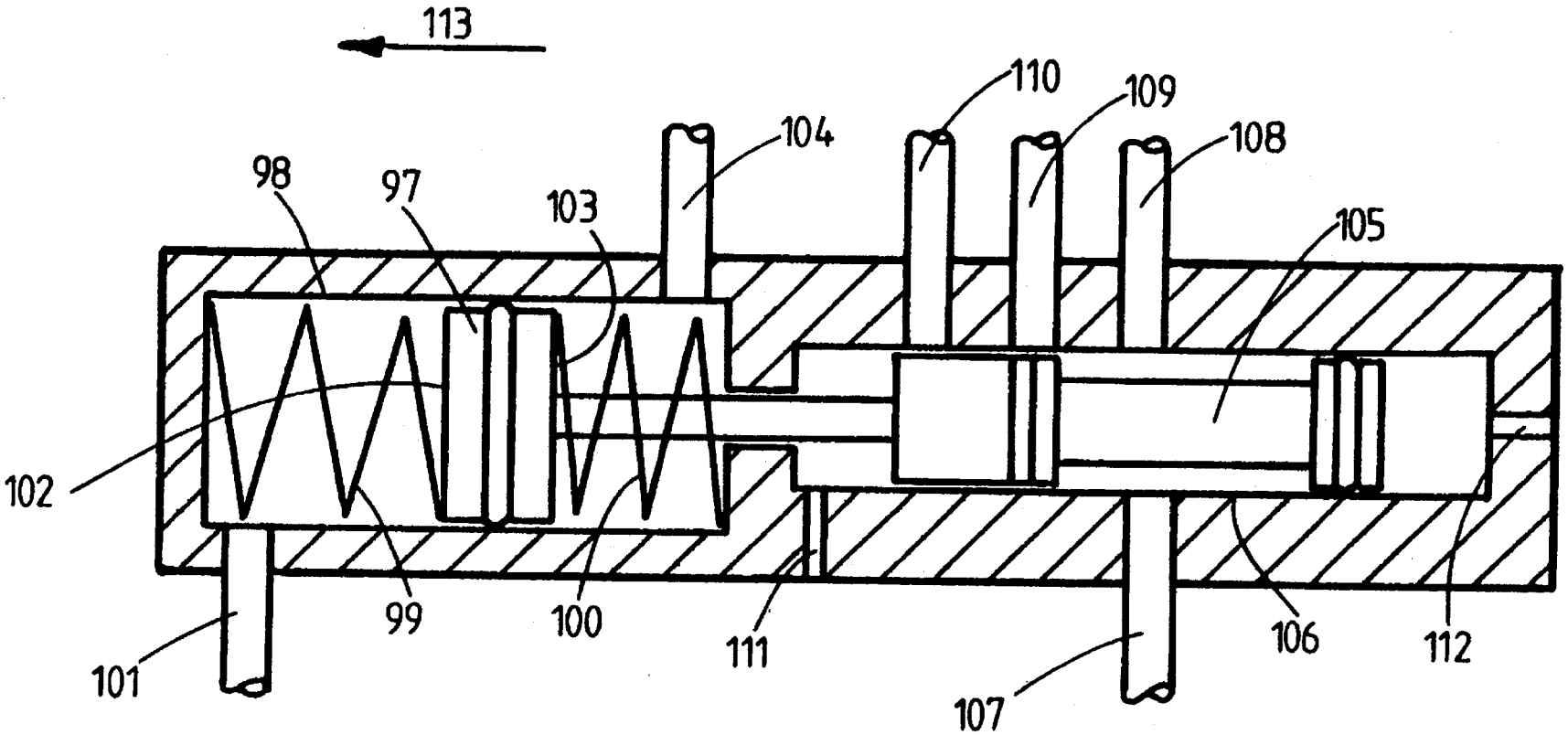
Figure 7:
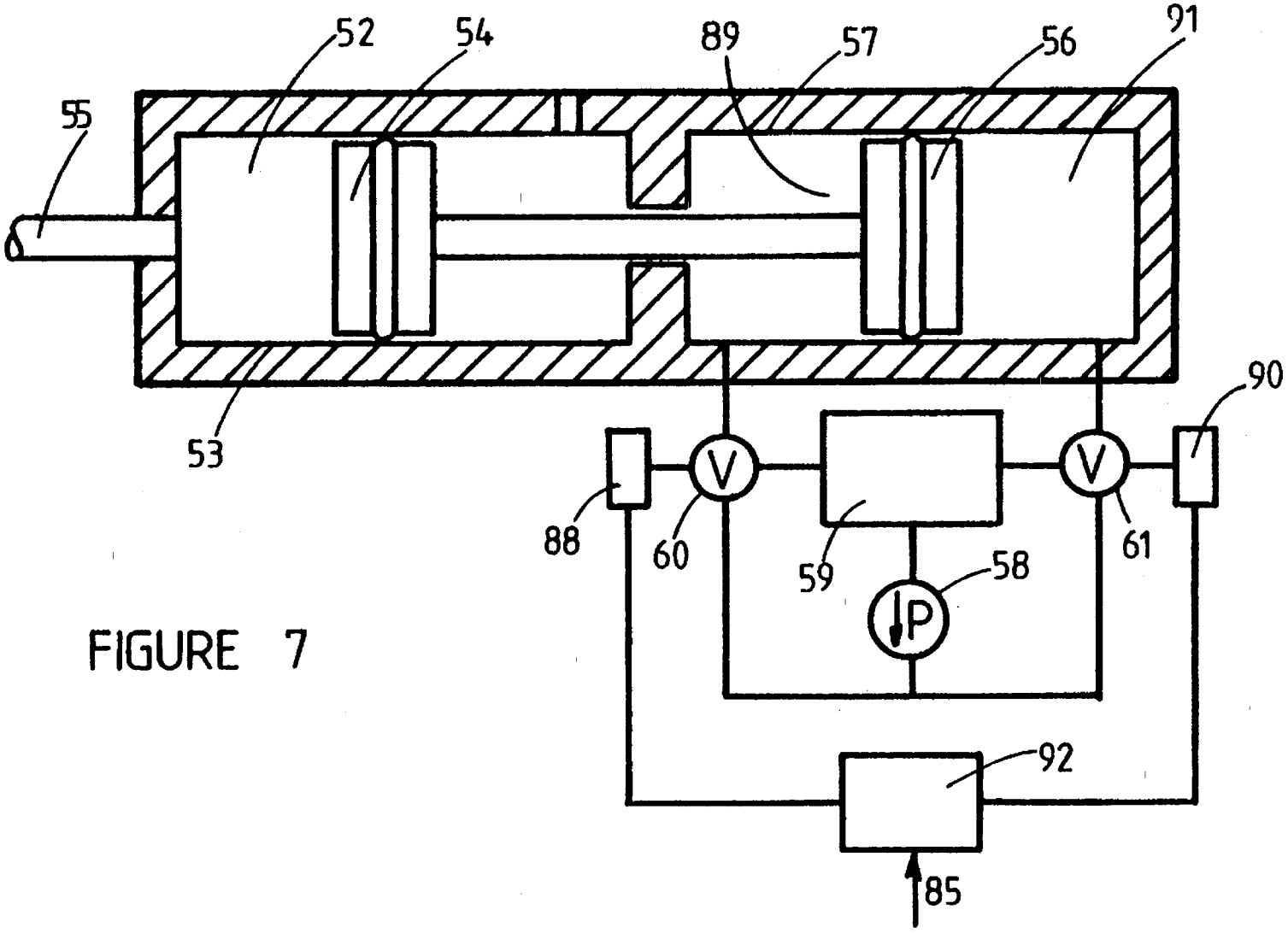

Modified elements of the FIG. 1 and FIG. 2 type of compensator are shown in FIG. 6 and in FIG. 7.

Figure 8:
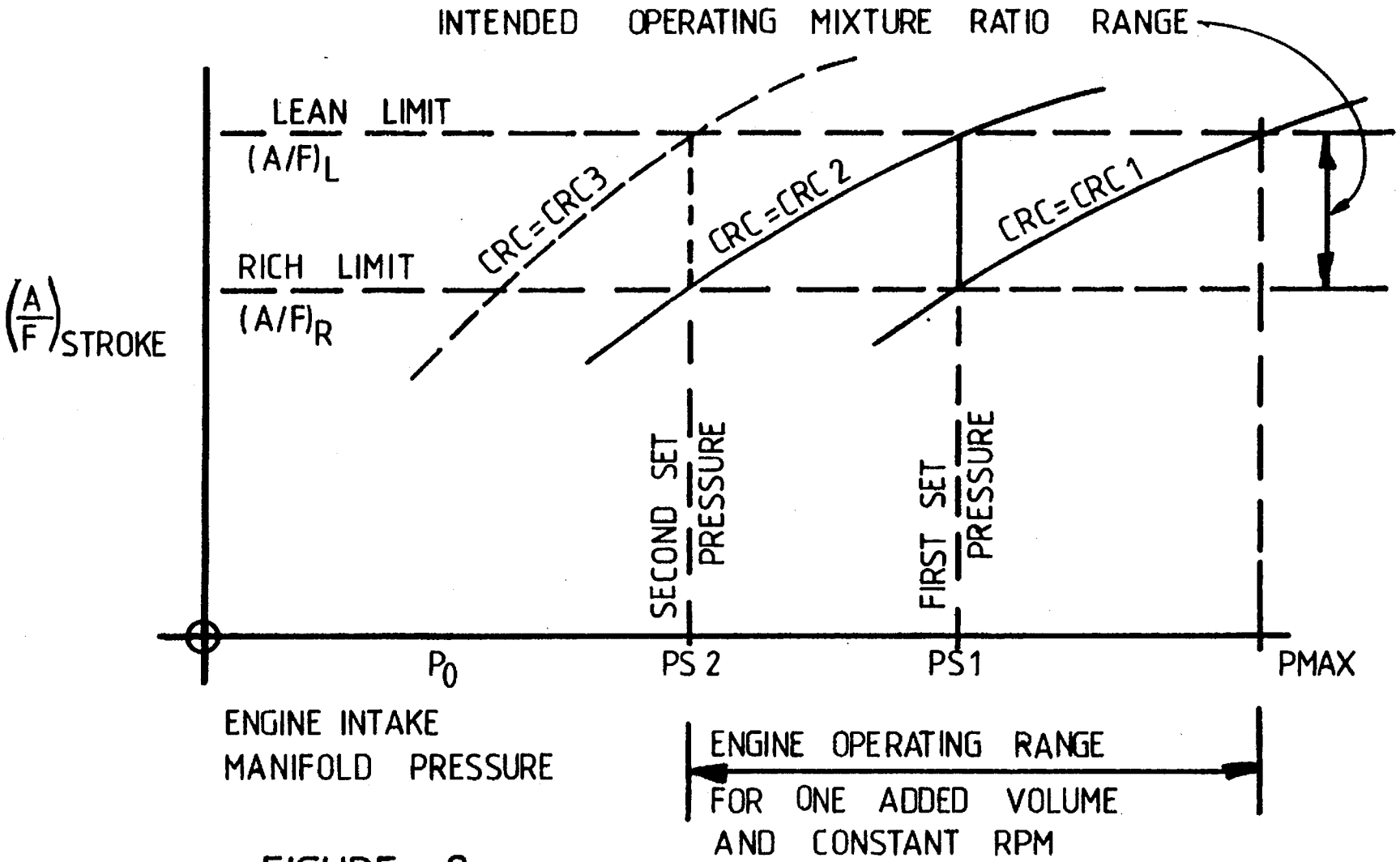

A graphical illustration of the operation of one example form of the invention is shown in FIG. 8.

DESCRIPTION OF THE PREFERRED EMBODIMENT

One example arrangement of a four stroke cycle internal combustion engine mechanism equipped with a gasoline fuel injection system is shown schematically in FIG. 1 and comprises the following:

1. A four stroke cycle, single cylinder, engine, 1, is shown with piston, 2, cylinder, 3, crankshaft, 4, connecting rod, 5, variable volume chamber, 6, air intake valve, 7, exhaust valve, 8, air supply manifold, 9, exhaust gas manifold, 10, fuel supply source, 11, and fuel supply pressure pump, 12, ignition means, 13.

2. The valve drive means is shown separated from the engine for clarity and comprises: a drive gear, 14, connected to the crankshaft, 4, and rotated at crankshaft speed, a valve drive gear, 15, rotated at half crankshaft speed by the drive gear, 14, and driving in turn the intake valve cam, 16, and the exhaust valve cam, 17. The intake and exhaust valves are opened by these cams and closed by springs, 18, 19.

In FIG. 1 the intake valve is shown open and the exhaust valve is shown closed with the piston descending on the intake stroke and increasing the volume of the variable volume chamber, 6, and intake air is flowing through the intake manifold, 9, and into the variable volume chamber, 6.

3. A gasoline engine fuel injection system, 20, shown in FIG. 1 comprises:

a. A fuel injector nozzle, 21, is injecting liquid fuel into the intake manifold, 9, whenever intake air is flowing into the engine cylinder. This liquid fuel flows from the liquid fuel chamber of the fuel injector means, 22.

b. A gas pressure cycling means, 23, is driven by a pressure cycler drive means, 24, which is in turn driven at twice crankshaft speed from the inter drive means, 25, driven in turn from the crankshaft drive gear, 14.

c. A pressure transmitter means, 26, transmits pressure from the gas pressure cycler, 23, to the liquid fuel chamber of the fuel injector, 22.

d. An intake stroke sensor, 27, is one input to a fuel valve controller means, 28, which controls the opening and closing of a nozzle valve and a fuel supply valve within the fuel injector means, 22, so that: the fuel injector nozzle, 21, is connected to the liquid fuel chamber of the fuel injector, 22, only whenever air is flowing into the variable volume chamber, 6, during the intake stroke; the engine fuel supply source is connected via pipe, 29, to the liquid fuel chamber of the fuel injector, 22, only when the nozzle valve is closed.

A particular example fuel injection system, 20, is shown in detail in cross section in FIG. 2 and FIG. 1 and comprises the following:

4. The gas pressure cycler, 23, comprises a variable volume chamber, 30, enclosed between the fixed cylinder container, 31, and the moveable sealed piston, 32, which is driven by the pressure cycler drive means cam, 33, and spring, 34, driven in turn from the inter drive means, 25. When the piston, 32, is moved by the cam, 33, to decrease the volume of the variable volume chamber, 30, the gas pressure therein rises, and when the piston, 32, is moved by the spring, 34, and the cam, 33, to increase the volume of the variable volume chamber, 30, the gas pressure therein decreases. In this way a cycle of pressure increase followed by pressure decrease is created at each revolution of the pressure cycler drive cam, 33, and this cycle is timed by the inter drive means, 25, to occur during and throughout each engine intake stroke. The pressure in the variable volume chamber, 30, at the start of each pressure cycle is equalized to that in the engine air intake manifold, 9, via the vent connections, 35, and 36.

5. The fuel injector means for injecting liquid fuel, 22, into the engine intake manifold, 9, comprises a liquid fuel chamber, 37, connectable and disconnectable to the fuel injector nozzle, 21, via the nozzle valve, 38, with nozzle valve drive means, 39, and connectable and disconnectable to the fuel supply source pipe, 29, via the fuel supply valve, 40, with supply valve drive means, 41. The fuel injector nozzle, 21, connects into the engine air intake manifold, 9. A liquid fuel sealed pressurizer piston, 42, applies force from the pressure transmitter, 26, to the liquid fuel within the liquid fuel chamber, 37, and has engine air intake manifold pressure acting on its opposite side, 45, via the vent connection, 36.

6. The pressure transmitter, 26, comprises a sealed gas piston, 43, acted on one side, 44, by the gas quantity in the variable volume chamber, 30, of the gas pressure cycler, 23, and acted on the other side by the pressure in the engine air intake manifold, 9, via the vent connection, 36. The sealed gas piston, 43, is connected directly to the liquid fuel pressurizer piston, 42, by the transmitter bar, 46, in this FIG. 2 form of the injector, so that, the force acting on the gas piston, 43, which is essentially proportional to the net pressure difference between the variable volume chamber, 30, and the air intake manifold, 9, acts also on the liquid fuel pressurizer piston, 42, to create a pressure in the liquid fuel chamber, 37, also essentially proportional to the net pressure difference between the variable volume chamber, 30, and the air intake manifold, 9. The side, 44, of the gas piston, 43, connects to the variable volume chamber, 30, via the pipe, 47.

7. The fuel valve controller, 28, receives an input signal from the intake stroke sensor, 27, and operates to open and close the nozzle valve, 38, and the fuel supply valve, 40, via their respective drive means, 39 and, 41, so that the nozzle valve, 38, is open only during and throughout the intake stroke, and so that the fuel supply valve, 40, is open only when the nozzle valve, 38, is closed. An electronic controller, 38, and solenoid or solenoid and spring drive means, 39, and, 41, are shown in this FIG. 2 form of the injector. But a wholly or partially mechanical drive means and controller can alternatively be used with the nozzle valve and fuel supply valve opened and closed by mechanical drive means, driven in turn via control drive from the engine crankshaft or camshaft, since the timing of these valves is essentially fixed relative to the engine piston and crankshaft motion.

8. When a fuel injection system as shown in FIG. 2 is used on a single cylinder engine, as shown in FIG. 1, a pressure and vent valve, 48, which opens to vent the pressure transmitter gas pressure side during the engine compression, expansion and exhaust strokes, and closes to transmit pressure from the gas pressure cycler to the gas pressure side of the pressure transmitter only during and throughout the engine air intake stroke is used.

The example fuel injection system shown in FIG. 2 and FIG. 1 operates as follows:

9. At the start of the intake stroke of the engine cylinder of air intake manifold, 9, the fuel valve controller, 28, having closed the fuel supply valve, 40, opens the nozzle valve, 38.

10. At the start of the intake stroke the pressure cycler drive cam, 33, centerline of symmetry, CS, is at an angle, Z, of 180 degrees to the moveable piston centerline, 63, and is being rotated in the direction, 64, by the inter drive means, 25. Thus, the variable volume, 30, starts at its maximum value.

11. During an intake stroke the pressure cycler drive cam, 33, will be rotated in the direction, 64, one full turn of 360 degrees during one full intake stroke of 180 degrees, crankshaft rotation. The pressure cycler drive cam, 33, and return spring, 34, thus moves the piston, 32, to first decrease the volume of the variable volume chamber, 30, and then to increase the volume of the variable volume chamber, 30, during each intake stroke. In this way a pressure cycle of pressure increase followed by pressure decrease is created in the variable volume chamber and this cycle of pressure is applied via the pressure transmitter, 26, to the liquid fuel in the liquid fuel chamber, 37.

12. The nozzle valve, 38, being open during and throughout the intake stroke, liquid fuel is forced by the pressure thusly created in the liquid fuel chamber, 37, through the fuel injector nozzle, 21, and into the air mass then flowing through the intake manifold, 9, and into the engine cylinder. The instantaneous mass rate of flow of liquid fuel into the engine air intake manifold, 9, during the intake stroke is approximately proportional to the square root of the pressure difference between the liquid fuel chamber, 37, and the air intake manifold, 9, and is approximately inversely proportional to the flow resistance of the fuel injector nozzle. The flow resistance of the fuel injector nozzle is approximately inversely proportional to the flow area thereof.

13. The air fuel ratio of the air fuel mixture being created in the intake manifold, 9, will be the ratio of the instantaneous mass rate of flow of air to the instantaneous mass rate of flow of fuel. The instantaneous mass rate of flow of air is roughly proportional to the instantaneous engine piston speed. An essentially constant air fuel ratio can be achieved in the air fuel mixture by designing the pressure cycler drive cam, 33, so that the resulting instantaneous mass rate of flow of fuel is proportional to the instantaneous mass rate of flow of air throughout the intake stroke. This particular profile of the pressure cycler drive cam is herein referred to as a constant mixture ratio cam profile and this cam profile will be preferred in many engine applications. Other cam profiles can be used, and other types of pressure cycler drive means can be used, such as the crank and connecting rod type of drive means, and these alternative drive means will create non uniform air fuel mixtures in the engine intake manifold.

14. At the end of the intake stroke the fuel valve controller, 28, closes the nozzle valve, 38. The fuel supply valve, 40, is then opened and the fuel supply pressure replaces that liquid fuel just previously injected by pushing the pressure transmitter pistons, 42, and 43, back against the stop, 163.

An example engine intake manifold pressure compensator, of this invention, of the valved volume type, is shown in FIG. 1 and FIG. 2, as connected to, and operative upon, the example gasoline fuel injector system shown thereon, and comprises:

15. At least one added volume, 49, enclosed in a pressure vessel, with volume valve, 50, connecting the added volume, 49, to the variable volume chamber, 30, of the gas pressure cycler, 23. The volume valve, 50, comprises a drive means for opening and closing the volume valve.

16. An intake manifold pressure sensor, 78, for sensing the pressure in the engine intake manifold, 9. This sensor can sense the static intake manifold pressure or, preferably, the total intake manifold pressure.

17. An intake manifold pressure compensator controller, 51, is responsive to the intake manifold pressure sensor, 78, and operates upon the volume valve drive means so that, when sensed engine intake manifold pressure decreases below a set value the volume valve, 50, is opened and, when sensed engine intake manifold pressure increases above a set value the volume valve, 50, is closed. The controller, 51, can be an electronic controller when an electronic pressure sensor, 76, is used, or can be a mechanical controller when a mechanical pressure sensor is used as described hereinafter.

This example intake manifold pressure compensator of FIG. 1 and FIG. 2 operates as follows when the engine is running:

18. As engine intake manifold pressure is decreased, as by reducing the opening of the intake throttle, 164, engine air mass per cycle, and also instantaneous air flow rate, decrease due to reduced air density.

19. When engine intake manifold pressure is decreased below the set value the added volume, 49, is added to the volume of the variable volume chamber, 30, by the opening of the volume valve, 50, thus decreasing gas pressure cycler compression ratio. In consequence the pressures created in the variable volume chamber, 30, and applied to the liquid fuel in the liquid fuel chamber, 37, via the pressure transmitter, 26, decrease. Thus the instantaneous rate of fuel flow through the fuel injector nozzle decreases, as required by the decrease of instantaneous air flow rate, in order to maintain the instantaneous air to fuel ratio within selected limits. This is one of the beneficial objects of this invention, that the instantaneous air to fuel ratio of the air fuel mixture created in the engine intake manifold can be kept within selected limits over a range of variation of intake manifold pressure.

20. For an engine operating over only a narrow range of intake manifold pressures, single added volume with controlled volume valve, as described hereinabove, may be sufficient to keep the instantaneous air to fuel ratio within the desired selected limits. As the engine operating range of intake manifold pressures increases, and also as the desired limits of operating air to fuel ratio is narrowed, an increasing number of added volumes with volume valves is required for this form of the invention. Where several added volumes are thusly utilized each volume valve has a different set pressure value at which it is opened or closed by its controller, so that, as intake manifold pressure is progressively decreased, a progressively increasing number of added volumes are added to the volume of the variable volume chamber of the gas pressure cycler.

21. This operation of the valved volume form of the invention at constant engine RPM is illustrated graphically on FIG. 8, wherein is plotted the overall mass ratio of air to fuel per intake stroke, (A/F) stroke, versus the intake manifold pressure, PO. For one particular value of the compression ratio, CRC1, of the gas pressure cycler, the overall air to fuel ratio becomes richer in fuel as intake manifold pressure, PO, decreases, since air mass per stroke decreases due to reduced air density, but fuel mass per stroke remains essentially constant. When overall air to fuel ratio has thusly reached the intended rich limit at the first set pressure, PSI, the first added volume valve is opened, thus decreasing the gas pressure cycler compression ratio to CRC2, and, by thusly decreasing fuel flow, leaning out the overall air to fuel ratio back to the intended lean limit. Engine overall air to fuel ratio will now remain within the intended operating range, as PO is further decreased, along the curve for CRC2, until the rich limit is again reached at the second set pressure, PS2. If only a single added volume compensator is used, the engine operating range of intake manifold pressure is limited to between PMAX and PS2, as shown on FIG. 8. But this engine operating range can be extended to lower values of PO by using a second added volume, whose volume valve is opened at the second set pressure, PS2, thus further decreasing the gas pressure cycler compression ratio to CRC3. In this way the engine operating range of intake manifold pressure can be extended as far as needed, by using a greater number of added valved volumes, while keeping the overall air to fuel ratio per intake stroke within the intended range. Also, as the intended operating mixture ratio range is narrowed, a greater number of added valved volumes are needed for a selected engine operating range of intake manifold pressure.

22. The values for the set pressures, PS1, PS2, etc., and the size of the added volumes, AVCL01, AVCL02, etc., are best determined experimentally on the engine. Approximate values of the set pressures and the added volumes can be estimated by use of the following equations:

$$(PSM) = \left(\frac{A}{F} R\right)^2 \frac{[(CRCM)^n - 1]}{(ks)^2}$$

$$(CRCM + 1) = \sqrt[n]{\frac{(ks)^2(psm)}{\left(\frac{A}{F} L\right)^2} + 1}$$

$$(AVCLOM) = \underline{VDC + VCL01[1 + (CRCM + 1)]}$$

Wherein:

(PSM)=Set pressure for the mth added volume to be opened;

$$\left(\frac{A}{F} R\right)$$

=Operating fuel rich mass ratio of air to fuel;

$$\left(\frac{A}{F} L\right)$$

=Operating fuel lean mass ratio of air to fuel;

(CRCM)=Gas pressure cycler compression ratio prior to the opening of the mth added volume;

n=Polytropic exponent for the gas compression and expansion processes in the gas pressure cycler variable volume;

$$(KS) = \frac{(VD)(ev)(3{,}1417)(\text{RPM})}{(RTO)(Al)\sqrt{2g(df)(J)}}$$

(AVCLOM)=Volume of the mth added volume $$(CRCM) = \frac{(VDC) + (VCL01) + (\text{Sum of } AVCLOM - 1)}{(VCL01) + (\text{Sum of } AVCLOM - 1)}$$

(VDC)=Displacement volume of the gase pressure cycler;

(VCL01)=Clearance volume of the gas pressure cycler when all added volume valves are closed;

(Sum of AVCLOM-1)=Sum of all added and opened volumes prior to the opening of the mth added volume;

(VD)=Engine piston displacement per cylinder;

(EV)=Engine volumetric efficiency;

(RPM)=Engine crankshaft speed;

R=Gas constant for air;

TO=Engine intake air absolute temperature;

(A1)=Flow area of liquid fuel orifice;

g=Gravitational constant;

J=Pressure transmitter transmission ratio;

$$J = \frac{(pf - po)}{(pa - po)}$$

(df)=Liquid fuel density;

(pf)=Pressure in liquid fuel chamber, absolute;

(pa)=Pressure in variable volume chamber of the gas pressure cycler, absolute;

Any consistent system of units can be used in these equations. These approximate equations are rearrangements of the equations for the constant mixture ratio cam presented in U.S. Pat. No. 5,456,232, incorporated herein by reference. The profile of a constant mixture ratio cam is a function of the compression ratio of the gas pressure cycler. Hence any one cam profile, used for driving the gas pressure cycler, can be a constant mixture ratio cam for only one of the several values of gas cycler compression ratios used with the different added volumes of this invention. Thus an error is introduced into the foregoing approximate equations when a single cam profile is used.

Where a single cam profile is used for a constant mixture ratio cam, the compression ratio of the gas pressure cycler, and the intake manifold pressure at which that compression ratio exists, are herein referred to as the design point compression ratio of the gas pressure cycler, and the design point intake manifold pressure. Preferably this design point is selected at the most commonly used value of engine intake manifold pressure, or in the middle of the operating range of engine intake manifold pressure.

23. Engine intake manifold pressure, PO, may change very rapidly in some types of engine service, such as passenger cars and trucks. For these services an intake manifold pressure compensator is wanted which responds quickly to changes in, PO, and this is one of the beneficial objects of the valved volume intake manifold pressure compensators, described hereinabove, that they respond quickly, since the volume valve can be quickly opened or closed when set pressure is reached.

24. In other types of engine service, such as water pumping, engine intake manifold pressure changes rather slowly. For these engine uses, an intake manifold pressure compensator using an adjustable added volume, as described hereinbelow, may be preferred. A single such adjustable added volume can function to hold overall air to fuel ratio per intake stroke within very narrow limits over a wide range of variation of intake manifold pressure.

25. A mechanical form of engine intake manifold pressure sensor and pressure compensator controller is shown in FIG. 6 and comprises:

(a) A pressure sensor piston, 97, operates sealably within a cylinder, 98, with springs, 99, 100, acting on both sides of the piston.

(b) Engine intake manifold pressure acts via connection, 101, upon the piston side, 102, and a reference pressure, such as atmospheric pressure, acts upon the opposite piston side, 103, via connection, 104.

(c) The sensor piston, 97, connects to a spool valve, 105, operating sealably within valve cylinder, 106. The valve cylinder is connected via connection, 107, to the variable volume chamber, 30, of the gas pressure cycler, 23. The valve cylinder, 106, is connected to three added volumes via the connections, 108, 109, 110, distributed along the length of the valve cylinder.

(d) The spool valve, 105, is balanced via vents, 111, 112.

This mechanical pressure sensor and compensator controller operates as follows:

(e) When engine intake manifold pressure decreases, sensor piston, 97, moves in the direction, 113, and, in consequence, the spool valve, 105, uncovers one or more connections between added volumes and the variable volume of the gas pressure cycler. More added volumes are thusly connected as engine intake manifold pressure is further decreased as desired for the controller.

(f) The opposite motion of the sensor piston, 97, and spool valve, 105, when engine intake manifold pressure increases, reduces the number of added volumes connected to the variable volume chamber of the gas pressure cycler.

An example intake manifold pressure compensator, of the adjustable added volume type is shown in FIG. 1, FIG. 2, and FIG. 7, and comprises:

26. An adjustable added volume, 52, enclosed within a cylinder, 53, and a moveable volume piston, 54, with connector, 55, to the variable volume chamber, 30, of the gas pressure cycler, 23.
27. The moveable volume piston, 54, connects to the driver piston, 56, operative sealably within the drive cylinder, 57.
28. The volume adjustment means of FIG. 7 further comprises a pump, 58, pumping fluid from a reservoir, 59, to the inlet of a volume increasing valve, 60, and also to the inlet of a volume decreasing valve, 61.
29. The actuator, 88, for the volume increasing valve, 60, opens the valve to admit pressure from the pump, 58, to the increase side, 89, of the driver piston, 56, and closes the valve, 60, to vent the increase side, 89, of the driver piston, 56, to the reservoir, 59.
30. Similarly the actuator, 90, for the volume decreasing valve, 61, opens the valve to admit pressure from the pump, 58, to the decrease side, 91, of the driver piston, 56, and closes the valve, 61, to vent the decrease side, 91, of the driver piston, 56, to the reservoir, 59.
31. An engine exhaust gas sensor, 85, senses the composition of the engine exhaust gas leaving the engine, 1, via the exhaust manifold, 10. Preferably, exhaust gas content of carbon monoxide, and also oxygen gas, are sensed by the sensor, 85. An oxygen sensor alone can function in this dual gas content sensing mode.
32. The adjustable volume feedback controller, 92, is responsive to the exhaust composition sensor, 85, and is operative upon the actuator, 88, and also the actuator, 90, to cause the volume increase valve, 60, to open, and concurrently to cause the volume decrease valve, 61, to close when the sensed exhaust gas content of carbon monoxide increases above a set value. The feedback controller, 92, operates upon the actuators, 88, 90, to cause the volume increase valve, 60, to close, and concurrently to cause the volume decrease valve, 61, to open when the sensed exhaust gas content of oxygen increases above a set value.
33. In this way the adjustable added volume, 52, is increased when over rich air fuel mixtures cause an increased carbon monoxide content of the exhaust gas. This increase of added volume decreases the compression ration, CRC, of the gas pressure cycler, 23, and, by thus decreasing the liquid fuel pressure in the liquid fuel chamber, decreases the fuel flow per intake stroke. The consequently leaner mixture ratio will reduce the carbon monoxide content of the exhaust gas.
34. In similar fashion the adjustable added volume, 52, is decreased when over lean air fuel mixtures cause an increased oxygen content of the engine exhaust gas. This decrease of added volume increases the compression ration, CRC, of the gas pressure cycler, 23, and, by thus increasing the liquid fuel pressure in the liquid fuel chamber, increases the fuel flow per intake stroke. The consequently richer mixture ratio will reduce the oxygen gas content of the exhaust gas.
35. The force of the pump pressure acting on the area of the driver piston, 56, is to exceed the maximum force of the pressure in the variable volume of the gas pressure cycler, 23, acting on the area of the moveable volume piston, 54, so that the desired volume adjustments can occur.
36. The pressure generating pump, 58, can be a hydraulic pump or a pneumatic pump. Alternative means for adjusting the adjustable volume, 52, such as electric actuators can also be used.
37. The maximum available volume of the adjustable added volume, 52, is best determined experimentally. An approximate value of this maximum available volume can be estimated from the following equation for the case where other added volumes are not used:

$$(AVCLOA) = \left\{ \frac{(VDC)}{\left[ \sqrt[n]{1 + (ks)^2 \frac{(pol)}{\left(\frac{A}{F}\right)_{stroke}}} \right] - 1} \right\} - (VCL01)$$

Wherein:

(AVCLOA)=Maximum available volume of the adjustable added volume, 52:

(pol)=Minimum operating value of engine intake manifold pressure;

$$\left(\frac{A}{F}\right)_{stroke}$$

=Intended operating value of the mass ratio of air to fuel per intake stroke;

Any consistent system of units can be used in this equation.

38. An adjustable added volume compensator for intake manifold pressure, such as shown in FIG. 7 and described hereinabove, can be used alone or in combination with other types of added volume compensators. These combinations can provide the quick response characteristic of the valved added volume compensator plus the more accurate, though slower, compensation characteristic of the adjustable added volume compensator.

Another type of added volume compensator for intake manifold pressure variation uses a valved volume, as described hereinabove, with an adjustable flow restrictor in the connection between the added volume and the variable volume of the gas pressure cycler. An example of such a flow restricted, valved added volume compensator is illustrated in FIG. 1 and FIG. 2, and comprises:

39. A valved added volume, similar to that described hereinabove and comprising: an added volume, 49, with volume valve, 50, intake manifold pressure sensor, 78, compensator controller, 51. These elements function in the same manner as the valved added volume described hereinabove;
40. An adjustable flow restrictor, 93, is placed in the connection, 94, from the added volume, 49, to the variable volume, 30, of the gas pressure cycler, 23. The flow restrictor comprises an adjustor, 95, for increasing or decreasing the flow area through the flow restrictor.
41. A feedback controller, 96, for controlling the adjustable flow restrictor, 93, is responsive to the exhaust composition sensor, 85, and is operative upon the adjustor, 95, of the adjustable flow restrictor, 93, so that:

(a) As engine exhaust gas content of oxygen gas increases, due to inadequate fuel flow, the flow area of the flow restrictor, 93, is decreased. The effect of the added volume, 49, in reducing gas pressure cycler compression ratio, and thus fuel pressure in the liquid fuel chamber, and hence fuel flow rate per stroke, is in this way partially offset. Consequently higher fuel flow results and mixture ratio is enrichened as desired.

(b) As engine exhaust gas content of carbon monoxide increases, due to excess fuel flow, the flow area of the flow restrictor, 93, is increased to reduce flow restriction. The effect of the added volume, 49, in reducing the compression ratio of the gas pressure cycler, 23, is thus increased. Consequently liquid fuel pressure and liquid fuel flow rate are reduced and mixture ratio becomes leaner as desired.

42. This valved volume compensator, with adjustable flow restrictor, form of the invention is responsive to both the engine intake manifold pressure and the engine exhaust gas composition. Engine mixture ratio can be kept within narrower limits when one or more of these flow restricted valved added volume compensators are substituted for an equal number of unrestricted valved volume compensators. This is one of the beneficial objects achievable by use of this flow restricted valved added volume compensators.

All of these several types of added volume compensators operate on the same principal of adjusting the compression ratio of the gas pressure cycler, in order to adjust the liquid fuel flow rate, and thus to adjust the mixture ratio of air to fuel per intake stroke. These added volume compensators can be used with any of the various gasoline fuel injector systems described in my earlier filed U.S. Pat. No. 5,456,232, incorporated herein by reference.

The pressure transmitter, 26, for the gasoline engine fuel injection system shown in FIG. 2, is a simple bar, 46, and the pressure transmitter transmission ratio, J, is a constant equal to the area ratio of the gas piston to the liquid piston. This fixed ratio type of pressure transmitter is satisfactory for use on engines operated at essentially constant speed, such as in electric power generation. For engines operated over a wide range of speeds, such as in trucks and automobiles, an adjustable ratio pressure transmitter is preferred, in combination with an RPM compensator of this invention.

One particular example of an adjustable ratio pressure transmitter, of the pivoted lever type, is shown in FIG. 3, as connecting to the engine, and in detail on a gasoline fuel injection system in FIG. 4, which comprises:

1. The gas pressure cycler, 23, comprising; variable volume chamber, 30, piston, 32, pressure cycler drive cam, 33, and return spring, 34, vent connection, 35, is similar to that of FIG. 2 and operates similarly as described hereinabove.
2. The fuel injector, 22, comprising liquid fuel chamber, 37, injector nozzle, 21, nozzle valve, 38, fuel supply valve, 40, is also similar to that of FIG. 2 and operates similarly as described hereinabove. A combined drive means, 65, for driving both the nozzle valve, 38, and the fuel supply valve, 40, is shown in FIG. 4 and can be a single solenoid driver which opens the nozzle valve when closing the fuel supply valve and vice versa.
3. The liquid fuel pressurizer liquid piston, 66, is connected to the end, 68, of a pivoted liver, 67, whose opposite end, 69, is connected to the pressure transmitter gas piston, 70, so that pressure created in the variable volume chamber, 30, of the gas pressure cycler, 23, is transmitted to the liquid fuel in the liquid fuel chamber, 37. The pivoted lever, 67, is pivoted about the pivot, 71, so that the force transmitted from the pressure transmitter piston, 70, to the liquid fuel pressurizer piston, 66, can be adjusted by moving the pivot, 71, in the directions, 72, relative to the ends, 69, and 68, of the lever, 67, where the gas piston, 70, and the liquid piston, 66, respectively connect to the lever, 67. The pivot, 71, is held by the pivot bar, 184, which is moveable in the direction, 72, along the alignment bar, 185. When the pivot, 71, is moved toward the liquid piston, 66, the net force transmitted to the liquid fuel in the liquid fuel chamber, 37, is increased relative to the net force acting on the gas piston, 70, the reverse effect occurring when the pivot, 71, is moved toward the gas piston, 70.

In this way the ratio of net liquid pressure on the liquid fuel in the liquid fuel chamber, 37, to the net gas pressure on the gas piston, 70, can be adjusted by varying the position of the pivot, 71, relative to the liquid piston, 66, and the gas piston, 70. Also in this way the instantaneous mass rates of flow of liquid fuel can be increased by moving the pivot toward the liquid piston, 66, and away from the gas piston, 70, and vice versa. When the instantaneous mass rates of flow of liquid fuel are thusly increased or decreased the mass rate of fuel flow per intake stroke is also correspondingly increased or decreased and thus the mean value of air fuel ratio for each intake stroke can be adjusted by adjusting the position of the pivot, 71, relative to the liquid piston, 66, and the gas piston, 70. For this pivoted lever type of adjustable ratio pressure transmitter, the pressure ratio, J, can be calculated as follows:

$$(J) = \frac{(pf - po)}{(pa - po)} = \frac{(Aa)(la)}{(Af)(lf)}$$

Wherein:

(Aa)=Area of gas piston, 70, of gas pressure cycler;

(Af)=Area of liquid piston, 66;

(1f)=Distance from pivot, 71, to the end, 68, where the liquid piston, 66, connects to the lever, 67;

(1a)=Distance from pivot, 71, to the end, 69, where the gas piston, 70, connects to the lever, 67;

An example engine RPM compensator of this invention is shown in FIG. 3 and FIG. 4 and comprises:

43. A positive displacement liquid pump, 114, is driven at a fixed multiple of engine RPM via the pump drivers, 115, 116, and pumps a liquid, from a liquid reservoir, 117, through a flow restrictor, 118, and back into the reservoir, 117.
44. The liquid pressure thusly generated between the pump, 114, and the flow restrictor, 118, is applied via connection, 119, to an actuator piston, 120, and spring, 121, in an actuator cylinder, 122.
45. This combination of liquid pump and flow restrictor is one form of engine RPM sensor which generates a signal, the generated liquid pressure at pump outlet, which is proportional to engine RPM. For the particular engine RPM sensor shown in FIG. 3 the relation between engine RPM and generated pressure at pump outlet can be approximated by the following equations:

$$[PP - PO] = (KR)\left[\frac{PRPM}{Ao}\right]^2$$

Wherein:

[PP-PO]=Net pressure signal above atmospheric at pump outlet and acting upon the actuator piston;

(PRPM)=Pump RPM, a fixed multiple, U, of engine RPM;

(PRPM)=(U) (Engine RPM)

(Ao)=Flow area of flow restrictor;

$$(KR) = \frac{(PD)^2}{(CO)^2(2g)}$$

(PD)=Liquid pump displacement per revolution;

(CO)=Flow restrictor orifice coefficient;

46. As engine RPM increases, the air mass per intake stroke remains roughly constant, but the fuel flow per intake stroke, for the FIG. 2 form of gasoline engine fuel injection system, decreases, since less time is available for fuel delivery during the intake stroke. So that the overall air to fuel ratio per intake stroke will remain constant over a wide range of engine RPM, the liquid fuel pressure in the liquid fuel chamber, 37, is to be increased as engine RPM increases by adjustment of the pivot position of the pivoted lever pressure transmitter shown in FIG. 4. An essentially constant overall mixture ratio can be thusly achieved by holding the ratio of engine RPM to the square root of the pressure transmitter pressure ratio, J, constant.
47. The piston rod, 173, of the actuator piston, 120, acts via the linear cam plate, 188, to adjust the pivot bar, 184, and pivot, 71, via the bar, 186, whose end, 187, rides in the cam groove, 191. The cam plate is constrained by the cam guide, 190, to be moveable only in the direction, 189.
48. The liquid reservoir, 117, and the spring side of the actuator piston, 120, are preferable vented to engine intake manifold pressure, PO, via connection, 123.
49. The profile of the linear cam, 191, is best determined experimentally. Where a constant mixture ratio cam type of gasoline fuel injector system is used the following approximate equation can be used for the linear cam profile:

$$(1a) = (1a + 1f)\left[1 - \frac{1}{1 + (kz)\,(\mathrm{RPM})^2}\right]$$

Wherein:

$$(KZ) = \frac{POD}{[(CRXD)^n - 1]}\left(\frac{Af}{Aa}\right)^2 \frac{Tr^2(VD)^2(ev)^2}{\left(\frac{A}{F}\right)_{stroke}(RTO)^2(Al)^2(2g)(df)}$$

(CRCD)=Compression ratio of the gas compression cycler at the design point for the constant mixture ratio cam;

(POD)=Intake manifold pressure at the design point for the constant mixture ratio cam;

This cam profile will give an approximately constant air fuel ratio per intake stroke over a wide range of engine RPM.

50. The above described linear cam, 191, and linkage connecting the cam, 191, to the pivot, 71, of the pivoted lever pressure transmitter comprises one form of pivot adjustor and driver for adjusting the pivot position relative to the gas piston and liquid piston.
51. The above described actuator piston, 120, and spring, 121, and cylinder, 122, comprises one form of engine RPM compensator controller for controlling the pivot adjustor and driver, and is responsive to the above described engine RPM sensor.

One method for introducing feedback from the exhaust composition sensor into the above described RPM compensator is to adjust the proportion of the signal, generated by the RPM sensor, to the engine RPM, by use of an adjustable proportioner. An example adjustable proportioner, 125, is shown in FIG. 3 and FIG. 5 and comprises:

52. The flow restrictor, 118, of the RPM compensator is made adjustable by moving the tapered valve, 126, relative to the valve seat, 127.
53. The tapered valve is moved by the valve driver, 128, acting on the threaded valve stem, 129.
54. The RPM feedback controller, 130, is responsive to the engine exhaust gas composition sensor, 85, and operative upon the tapered valve driver, 128, so that:
    (a) As engine exhaust gas content of oxygen gas increases, due to overlean operation, the tapered valve, 126, is adjusted by the valve driver, 128, to reduce the area of the flow restrictor, 118. Thus the pressure signal generated by the pump, 114, of the RPM compensator, is increased at the same RPM. This increased pressure acts on the actuator piston, 120, and thence, via the pivot adjustor, to move the pivot, 71, closer to the liquid piston. In this way the liquid fuel pressure in the liquid fuel flow rate is increased to correct the overlean mixture condition.
    (b) As engine exhaust gas content of carbon monoxide increases, due to overrich operation, the tapered valve, 126, is adjusted by the valve driver, 128, to increase the flow area of the flow restrictor. The consequently reduced pressure signal acts, as described above, to reduce the liquid fuel pressure in the liquid fuel chamber, 37, and thus to reduce liquid fuel flow rate in order to correct the overrich mixture condition.
    (c) In this way feedback from the exhaust composition sensor, 85, can adjust the overall air to fuel mixture ratio to keep it within narrow limits of minimum emissions, or maximum efficiency, or maximum power as desired.

Very few gasoline engines operate at constant intake manifold pressure and variable RPM, so at present there are few occasions to use an RPM compensator of this invention alone. In most cases an RPM compensator will be used in combination with an intake manifold pressure compensator. The RPM compensators of this invention are useable with gasoline fuel injector systems comprising adjustable ratio pressure transmitters, such as the pivoted lever type of pressure transmitter described hereinabove.

The intake manifold pressure and engine RPM compensators of this invention can be used as substitutes for the gasoline fuel injection system actuators described in my earlier filed U.S. Pat. No. 5,483,937, entitled "Actuator for Gasoline Fuel Injector System." The present compensators differ from this earlier actuator in several ways as, for example, the following ways:

55. The earlier actuator combines the intake pressure and RPM signals to adjust only the adjustable ratio pressure transmitter. In contrast, the present compensators apply the intake manifold pressure signal to change the compression ratio of the gas pressure cycler and apply the RPM signal separately to change the pressure ratio of the adjustable ratio pressure transmitter.
56. The earlier actuator used an air compressor and pneumatic actuator, whereas the present compensator uses a liquid pump and hydraulic actuator for the RPM compensator.
57. The present compensator scheme is mechanically simpler and capable of more rapid response to intake manifold pressure changes. These are some of the beneficial objects achieved by the invention described hereinabove.

Having thus described my invention what I claim is:

1. In a four stroke cycle internal combustion engine mechanism comprising: at least one piston, operative within a cylinder, and connected to a crankshaft via a connecting rod; each said piston and cylinder comprising: a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a valve drive means from said crankshaft; said valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valve are closed by said valve drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold;

said four stroke cycle internal combustion engine mechanism further comprising engine fuel injection systems wherein each said piston and cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising, a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply manifold only during the ending of said pressure decrease and the start of the next said pressure increase so that said starting pressure essentially equals the pressure in said engine air supply manifold;

fuel injector means for injecting liquid fuel into said engine air supply manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening closing said fuel supply valve means, a liquid fuel pressurizer means for applying pressure to said liquid fuel in said liquid fuel chamber;

said fuel injector nozzle of said fuel injector means connecting into said engine air supply manifold;

pressure transmitter means for transmitting pressure from said variable volume chamber of said gas pressure cycling means to said liquid fuel pressurizer means of said fuel injector means so that pressure increase in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means, said pressure transmitter means comprising: means for connecting and disconnecting said pressure transmitter to said variable volume chamber of said gas pressure cycling means so that, pressure increase and decrease in said variable volume chamber act upon said pressure transmitter only during and throughout each said air intake stroke, and so that the pressure acting upon said liquid fuel in said liquid fuel chamber via said pressure transmitter is less than said liquid fuel supply pressure during and throughout each said compression stroke, expansion stroke and exhaust stroke;

inter drive means for driving said pressure cycler drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from essentially the start to the end of each said air intake stroke, and so that said fuel supply valve means connects said liquid fuel chamber to said engine fuel supply source only when said nozzle valve means has disconnected said fuel injector nozzle from said liquid fuel chamber;

wherein said liquid fuel pressurizer means of said fuel injector means comprises a liquid piston acting sealably on one side upon said liquid fuel within said liquid fuel chamber, the opposite side of said liquid piston being connected to said engine air supply manifold;

wherein said pressure transmitter means comprises: a gas piston acted on one side sealably by said gas quantity within said variable volume chamber of said gas pressure cycling means; the opposite side of said gas piston being connected to said engine air supply manifold;

wherein said pressure transmitter means further comprises pivoted lever means for transmitting force from said gas piston to said liquid piston of said liquid fuel pressurizer and comprising a pivot, so that; whenever the gas pressure acting on the variable volume chamber side of said gas piston changes, the liquid pressure of said liquid fuel within said liquid fuel chamber of said fuel injector means changes in the same direction; and so that; the ratio of said net gas pressure to said net liquid pressure remains essentially constant when said pivot of said pivoted lever means is fixed relative to said gas piston and said liquid piston;

wherein the improvement comprises adding to each said engine fuel injection system an engine RPM compensator comprising:

an engine RPM sensor means for generating a signal proportioned to said engine RPM;

a pivot adjustment means for adjusting the position of the pivot of said pivoted lever pressure transmitter, relative to said gas piston and said liquid piston, and comprising pivot drive means for moving the pivot;

an engine RPM compensator control means for controlling said pivot drive means of said pivot adjustment means, responsive to said engine RPM sensor signal, and operative upon said pivot drive means, so that as engine RPM is increased, said pivot is moved toward said liquid piston, in order to increase the ratio of liquid pressure to gas pressure, and as engine RPM is decreased said pivot is moved toward said gas piston, in order to decrease the ratio of liquid pressure to gas pressure.

2. In a four stroke cycle internal combustion engine mechanism as described in claim 1, and further comprising an engine exhaust sensor means for sensing the composition of the engine exhaust gas;

wherein said engine RPM sensor further comprises adjustable proportioner means for adjusting the proportion between said generated signal and said engine RPM, said proportioner means being responsive to said exhaust sensor means, so that as engine exhaust gas content of oxygen gas is increased, said proportion of generated signal to engine RPM is increased, and as engine exhaust gas content of carbon monoxide is increased, said proportion of generated signal to engine RPM is decreased.

3. In a four stroke cycle internal combustion engine mechanism as described in claim 1 and further comprising an engine intake manifold pressure compensator for each said engine fuel injection system, said engine manifold pressure compensator comprising:

at least one added volume contained within a pressure vessel, and each said added volume comprising a volume valve and connection from said added volume to said variable volume chamber of said gas pressure cycling means, and comprising volume valve drive means for opening and closing said volume valve;

an engine intake manifold pressure sensor means for sensing intake manifold pressure;

an intake manifold pressure compensator control means for controlling the opening and closing of said volume valves, responsive to said engine intake manifold pressure sensor, and operative upon said volume valve drive means, so that as intake manifold pressure is decreased, a larger number of said volume valves are opened, and as intake manifold pressure is increased, a larger number of said volume valves are closed.

4. In a four stroke cycle internal combustion engine mechanism as described in claim 3 and further comprising:

an engine exhaust sensor means for sensing the composition of the engine exhaust gas;

volume adjustment means for adjusting the volume of at least one of said added volumes;

feedback control means for controlling said volume adjustment means, responsive to said exhaust sensor means, and operative upon said volume adjustment means, so that, as engine exhaust gas content of oxygen gas increases, said at least one added volume is adjusted to a smaller volume, and as engine exhaust gas content of carbon monoxide increases, said at least one added volume is adjusted to a larger volume.

5. In a four stroke cycle internal combustion engine as described in claim 3 and further comprising:

an engine exhaust sensor means for sensing the composition of the engine exhaust gas;

an adjustable flow restrictor in said volume valve connection from said added volume to said variable volume chamber of said gas pressure cycling means, and comprising means for adjusting said flow restrictor;

feedback control means for controlling said adjustable flow restrictor, responsive to said exhaust sensor means, and operative upon said means for adjusting said flow restrictor, so that as engine exhaust gas content of oxygen gas increases said flow restrictor is adjusted to increase flow restriction, and as engine exhaust gas content of carbon monoxide increases, said flow restrictor is adjusted to decrease flow restriction.

6. In a four stroke cycle internal combustion engine mechanism comprising: at least one piston, operative within a cylinder, and connected to a crankshaft via a connecting rod; each said piston and cylinder comprising: a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a valve drive means from said crankshaft; said valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valve are closed by said valve drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold;

said four stroke cycle internal combustion engine mechanism further comprising engine fuel injection systems wherein each said piston and cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising, a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply manifold only during the ending of said pressure decrease and the start of the next said pressure increase so that said starting pressure essentially equals the pressure in said engine air supply manifold;

fuel injector means for injecting liquid fuel into said engine air supply manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening closing said fuel supply valve means, a liquid fuel pressurizer means for applying pressure to said liquid fuel in said liquid fuel chamber;

said fuel injector nozzle of said fuel injector means connecting into said engine air supply manifold;

pressure transmitter means for transmitting pressure from said variable volume chamber of said gas pressure cycling means to said liquid fuel pressurizer means of said fuel injector means so that pressure increase in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means, said pressure transmitter means comprising: means for connecting and disconnecting said pressure transmitter to said variable volume chamber of said gas pressure cycling means so that, pressure increase and decrease in said variable volume chamber act upon said pressure transmitter only during and throughout each said air intake stroke, and so that the pressure acting upon said liquid fuel in said liquid fuel chamber via said pressure transmitter is less than said liquid fuel supply pressure during and throughout each said compression stroke, expansion stroke and exhaust stroke;

inter drive means for driving said pressure cycler drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from essentially the start to the end of each said air intake stroke, and so that said fuel supply valve means connects said liquid fuel chamber to said engine fuel supply source only when said nozzle valve means has disconnected said fuel injector nozzle from said liquid fuel chamber;

wherein the improvement comprises adding to each said engine fuel injection system an engine intake manifold pressure compensator comprising:

at least one added volume contained within a pressure vessel, and each said added volume comprising a volume value and connection from said added volume to said variable volume chamber of said gas pressure cycling means, and comprising volume valve drive means for opening and closing said volume valve;

an engine intake manifold pressure sensor means for sensing intake manifold pressure;

an intake manifold pressure compensator control means for controlling the opening and closing of said volume valves, responsive to said engine intake manifold pressure sensor, and operative upon said volume valve drive means, so that as intake manifold pressure is decreased, a larger number of said volume valves are opened, and as intake manifold pressure is increased, a larger number of said volume valves are closed.

7. In a four stroke cycle internal combustion engine mechanism as described in claim 6 and further comprising:

an engine exhaust sensor means for sensing the composition of the engine exhaust gas;

volume adjustment means for adjusting the volume of at least one of said added volumes;

feedback control means for controlling said volume adjustment means, responsive to said exhaust sensor means, and operative upon said volume adjustment means, so that, as engine exhaust gas content of oxygen gas increases, said at least one added volume is adjusted to a smaller volume, and as engine exhaust gas content of carbon monoxide increases, said at least one added volume is adjusted to a larger volume.

8. In a four stroke cycle internal combustion engine mechanism as described in claim 6 and further comprising:

an engine exhaust sensor means for sensing the composition of the engine exhaust gas;

an adjustable flow restrictor in said volume valve connection from said added volume to said variable volume chamber of said gas pressure cycling means, and comprising means for adjusting said flow restrictor;

feedback control means for controlling said adjustable flow restrictor, responsive to said exhaust sensor means, and operative upon said means for adjusting said flow restrictor, so that as engine exhaust gas content of oxygen gas increases, said flow restrictor is adjusted to increase flow restriction, and as engine exhaust gas content of carbon monoxide increases, said flow restrictor is adjusted to decrease flow restriction.

9. In a four stroke cycle internal combustion engine mechanism comprising: at least one piston, operative within a cylinder, and connected to a crankshaft via a connecting rod; each said piston and cylinder comprising: a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a valve drive means from said crankshaft; said valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valve are closed by said valve drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold;

said four stroke cycle internal combustion engine mechanism further comprising engine fuel injection systems wherein each said piston and cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising, a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply manifold only during the ending of said pressure decrease and the start of the next said pressure increase so that said starting pressure essentially equals the pressure in said engine air supply manifold;

fuel injector means for injecting liquid fuel into said engine air supply manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening closing said fuel supply valve means, a liquid fuel pressurizer means for applying pressure to said liquid fuel in said liquid fuel chamber;

said fuel injector nozzle of said fuel injector means connecting into said engine air supply manifold;

pressure transmitter means for transmitting pressure from said variable volume chamber of said gas pressure cycling means to said liquid fuel pressurizer means of said fuel injector means so that pressure increase in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means, said pressure transmitter means comprising: means for connecting and disconnecting said pressure transmitter to said variable volume chamber of said gas pressure cycling means so that, pressure increase and decrease in said variable volume chamber act upon said pressure transmitter only during and throughout each said air intake stroke, and so that the pressure acting upon said liquid fuel in said liquid fuel chamber via said pressure transmitter is less than said liquid fuel supply pressure during and throughout each said compression stroke, expansion stroke and exhaust stroke;

inter drive means for driving said pressure cycler drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from essentially the start to the end of each said air intake stroke, and so that said fuel supply valve means connects said liquid fuel chamber to said engine fuel supply source only when said nozzle valve means has disconnected said fuel injector nozzle from said liquid fuel chamber;

wherein the improvement comprises adding to each said engine fuel injection system an engine intake manifold pressure compensator comprising:

an engine exhaust sensor means for sensing the composition of the engine exhaust gas;

at least one adjustable added volume, contained within a pressure vessel and comprising a connection from said adjustable added volume to said variable volume of said gas pressure cycling means, and further comprising volume adjustment means for adjusting said adjustable added volume, feedback control means for controlling said volume adjustment means, responsive to said exhaust sensor means, and operative upon said volume adjustment means, so that, as engine exhaust gas content of oxygen gas increases, said at least one added volume is adjusted to a smaller volume, and as engine exhaust gas content of carbon monoxide increases, said at least one added volume is adjusted to a larger volume.

* * * * *